US005899598A

United States Patent [19]

Yamauchi

[11] Patent Number: 5,899,598

[45] Date of Patent: May 4, 1999

[54] FIXING DEVICE HAVING A FIXING TEMPERATURE SWITCHING MECHANISM, METHOD FOR CONTROLLING TEMPERATURE OF THE FIXING DEVICE AND IMAGE FORMING APPARATUS HAVING THE FIXING DEVICE

[75] Inventor: Shin Yamauchi, Tokyo, Japan

[73] Assignee: Kabushiki Kaisha Toshiba, Kawasaki, Japan

[21] Appl. No.: 09/046,530

[22] Filed: Mar. 24, 1998

[30] Foreign Application Priority Data

Mar. 31, 1997 [JP] Japan ..... 9-081696

[51] Int. Cl.[6] ..... G03G 15/20

[52] U.S. Cl. ..... 399/67

[58] Field of Search ..... 399/330, 331, 399/332, 67, 69, 45; 219/216

[56] References Cited

U.S. PATENT DOCUMENTS

| | | | |
|---|---|---|---|
| 5,075,732 | 12/1991 | Menjo | 399/45 |
| 5,408,301 | 4/1995 | Tokishige et al. | 399/69 |
| 5,768,655 | 6/1998 | Yoshino et al. | 399/69 |

FOREIGN PATENT DOCUMENTS 60-188968 3/1985 Japan .

*Primary Examiner*—S. Lee
*Attorney, Agent, or Firm*—Foley & Lardner

[57] ABSTRACT

A microcomputer control section is such that, when switching is mode from a plain sheet mode to a sheetboard/OHP mode by the operation of a corresponding keys on an operation panel, the microcomputer control section changes the control temperature of an upper roller to an equivalent bit value so as to vary that control temperature from 150° C. to 160° C. during which time the microcomputer control section, confirming the surface temperature of an upper roller from a detection signal of a sensing section through an A/D conversion section, turns an upper lamp heater ON through a lamp control section if the surface temperature of the upper roller is below 155° C. and, effecting continued confirmation of the surface temperature of the upper roller from the detection signal of the sensing section through the A/D conversion section, turns the upper lamp heater OFF through the lamp control section when the surface temperature of the upper roller increases above 160° C., so that a sheetboard/OHP sheet-ready (copyable) state is displayed on a liquid-crystal display section on an operation panel.

8 Claims, 5 Drawing Sheets

FIXING DEVICE HAVING A FIXING TEMPERATURE SWITCHING MECHANISM, METHOD FOR CONTROLLING TEMPERATURE OF THE FIXING DEVICE AND IMAGE FORMING APPARATUS HAVING THE FIXING DEVICE

BACKGROUND OF THE INVENTION

The present invention relates to a fixing device having a fixing temperature switching mechanism and allowing an image which is read out from a document for instance and transferred to a sheet to be fixed to a medium while heating the medium fed by heating rollers, temperature control method for controlling the temperature of the fixing device and image forming apparatus, such as an electronic copying machine, equipped with the fixing device.

Conventionally, with an image forming apparatus, such as an electronic copying machine, a document on a document glass (document placing glass) is scanned with a light exposure lamp, a corresponding optical image is guided as reflected light to a photosensitive drum to provide a corresponding latent image there, the latent image is visualized with a toner applied by a developing device thereto, the visualized image as a toner image is transferred by a transfer device to a sheet, and the toner image on the sheet is fixed by a fixing device to the sheet.

The fixing device comprises a heating roller with a halogen lamp incorporated therein and another pressing roller and fixes a toner image to the sheet by applying temperature and pressure by these rollers to the toner-image-bearing sheet.

If, on a full-color copying machine, coping is made on an OHP sheet, sheetboard, etc., which are poor in a fixing property compared with a plain paper sheet, it is done such that each sheet passes through the fixing device at an about 50% speed-reduced rate.

This process speed reducing method results in a copying capability being reduced to about 50%, meaning that, for example, only 10 sheets can be copied in units of a minute instead of 20 sheets. Further, in order that only a fixing process is delayed with a charging, developing, transferring and separating process (pre-fixing process) kept constant, a spacing corresponding to at least an A-size sheet is required between the transferring/separating process and a nip site of the fixing device, resulting in a larger-sized apparatus.

For this reason, a temperature control method is considered by which a fixing temperature is elevated only if the OHP sheet, sheetboard or the like are to be fixed. As fixing rollers for a full-color fixing device, rubber rollers are used for high image definition. Since, however, the rubber roller is poor in heat response property than a hard roller, a time as long as 120 seconds per 10 deg. is taken for the temperature of the rubber roller to be lowered in the fixing of an image-transferred sheet at a concentration level suitable to the plain sheet after an OHP sheet has been fixed. If the roller surface temperature per se is set to be higher than even in the case of a plain sheet, the deterioration of the roller rubber is hastened, thus involving a 30% fall in the life of the roller.

BRIEF SUMMARY OF THE INVENTION

It is accordingly the object of the present invention to provide a fixing device which is equipped with a fixing temperature switching mechanism for making proper temperature control without the need for reducing a copying speed to about 50% level and for increasing a device size, as well as a method for controlling the temperature of the fixing device and image forming apparatus equipped with the fixing device.

According to one aspect of the present invention, there is provided a fixing device for fixing a toner image on a transfer material being fed thereto, while being held between rollers, at a predetermined fixing temperature, comprising:

a first roller;

heating means for heating the first roller;

a second roller set in contact with the first roller at a temperature lower than the temperature of the first roller;

switching means for effecting switching between a first mode for fixing the image to the transfer material at a first fixing temperature and a second mode for fixing the image to the transfer material at a second fixing temperature higher than the first fixing temperature;

first control means for heating the first roller at a higher temperature when the second mode is selected than when the first mode is selected; and second control means for controlling the second roller so that the second roller deprive heat of the first roller when switching is made by the switching means from the second mode to the first mode.

According to another aspect of the present invention, there is provided a method for controlling temperature of a fixing device for fixing a toner image on a medium being fed thereto while being held between first and second rollers, comprising the steps of:

(a) controlling a surface temperature of the first roller at a plurality of setting levels;

(b) controlling a surface temperature of the second roller to a level equal to the lowest setting level of the first roller; and (c) when the surface temperature of the first roller is to be lowered, controlling the two rollers in a way to set these rollers rotating in contact with each other.

According to another aspect of the present invention there is provided an image forming apparatus comprising:

transfer means for transferring a toner image which is read out from a document to be transferred to a medium conveyed thereto;

fixing means, having first and second rollers, for fixing the transferred toner image to the medium at a predetermined fixing temperature, while holding the medium between mutually contacted first and second rollers, to which heating is made;

heating means for heating the first roller;

detecting means for detecting a surface temperature of the first roller heated by the heating means;

setting means for setting a first mode for fixing at a first fixing temperature and second mode for fixing at a second fixing temperature higher than the first fixing temperature;

first controlling means for, when the first and second modes are set by the setting means, controlling heating by the heating means on the basis of a result of detection by the detecting means to obtain a temperature level corresponding to the set mode and second controlling means for, when the set mode is changed to the first mode from the second mode by the setting means, controlling the second roller so that the second roller deprive heat of the first roller.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The aspect of one embodiment of the present invention will be explained below with reference to the accompanying drawing.

Figure 1:
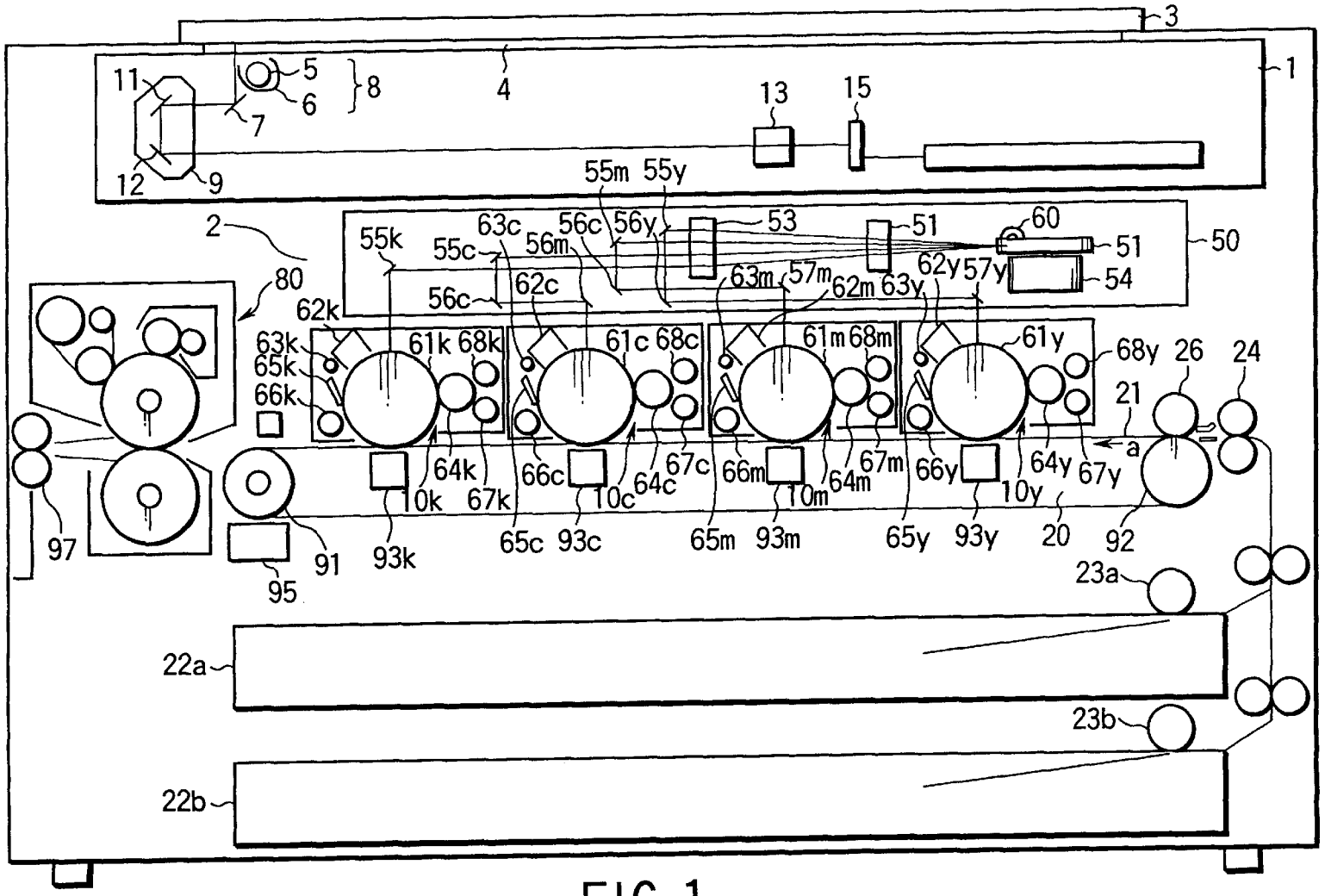
FIG. 1 is a cross-sectional view showing an arrangement of a full-color copying machine according to an image forming apparatus of the present invention.

FIG. 1 shows an arrangement of a full-color copying machine according to an image forming apparatus of the present invention. The full-color copying machine comprises a scanner section 1 serving as a reading-out means and printer section 2 serving as an image forming means.

The scanner section 1 for reading out a document image has a document-glass cover 3 on its upper side and a document glass 4 arranged opposite to the document-glass cover 3 with the cover 3 closed and comprised of transparent glass on which the document D is set. Below the document glass 4 are arranged an exposure light lamp 5 for illuminating the document D set on the document glass, a reflector 6 for allowing light which originates from the exposure lamp 5 to condense to the document D, and a first mirror 7, etc., which allows light which is reflected from the document D to be bent toward a left direction in FIG. 1. The exposure lamp 5, reflector 6 and first mirror 7 are fixed to a first carrier 8. The first carriage 8 is connected to a pulse motor, not shown, through a tooth-equipped belt, and so on, not shown and moved in a parallel direction along the document glass 4 when a drive force of a pulse motor is transmitted thereto.

On the left side relative to the first carriage 8 in FIG. 1, that is, in a direction in which light reflected by the first mirror 7 is guided, a second carriage 9 is provided to be movable in parallel with the document glass 4 through a drive mechanism, not shown, such as a tooth-equipped belt and DC motor. A second mirror 11 is arranged in the second carriage 9 to allow the light which is reflected by the first mirror to be bent downwardly and a third mirror 12 is arranged in the second mirror 12 at an angle perpendicular to the second mirror 11 to allow the light which is reflected from the second mirror 11 to be bent in a right direction in FIG. 1. The second carriage 9 is driven by the first arrange 8 to be moved in parallel to the first carriage 8 at a ½ speed along the document glass 4.

An image forming lens 13 is arranged in a plane including an optical axis of the light reflected back through the second carriage 9 to allow the light which is reflected from the second carriage 9 to be image-formed at a predetermined magnification. In a plane substantially perpendicular to the optical axis of the light passed through the image-forming lens 13 a CCD image sensor (photoelectric conversion element) 15 is arranged to allow the reflected light which has its focusing given by the image-forming lens 13 to be converted to an electric signal, that is, image data.

That is, after the light from the exposure lamp 5 is directed by the reflector 6 onto a document D on the document glass 4, the light reflected from the document D is guided through the first mirror 7, second mirror 11, third mirror 12 and image-forming lens 13 to the CCD image sensor 15 where it is converted to the image data.

The printer section 2 has first, second, third and fourth image forming sections 10*y*, 10*m*, 10*c* and 10*k* which form, based on the well-known subtractive color mixing method, color-separated images of respective color components, that is, the four color images yellow (hereinafter referred to as y), magenta (one kind of red: hereinafter referred to as m), cyan (bluish purple: hereinafter referred to as c) and black (hereinafter referred to as k).

A conveying belt 21 serving as a conveying means is so arranged as to include a conveying belt 21 provided below the respective image forming section 10*y*, 10*m*, 10*c* and 10*k* to convey images of respective colors formed by the respective image forming sections. The conveying belt 21 is run between a drive roller 91 rotated by a belt motor, not shown, toward an arrow a side and a driven roller 92 spaced a predetermined distance apart from the drive roller 91, that is, run at a constant speed toward the arrow a side in an endless way. The respective image forming sections 10*y*, 10*m*, 10*c* and 10*k* are arranged in a serial array along a conveying direction of the conveying belt 21.

The respective image forming sections 10*y*, 10*m*, 10*c* and 10*k* include photosensitive drums 61*y*, 61*m*, 61*c* and 61*k*, serving as image carriers, whose outer circumferential surfaces are rotatable in the same direction in a way to be set in contact with the conveying belt 21. A drum motor, not shown, is connected to the corresponding photosensitive drum to rotate the drum at a predetermined peripheral speed.

The photosensitive drums 61*y*, 61*m*, 61*c* and 61*k* have their axes set orthogonal to the conveying direction of the image by the conveying belt 21 and their axes set equidistant to each other. In an explanation given below, the axial direction of the respective photosensitive drum is referred to as a main scanning direction (second direction) and the rotation direction of the photosensitive drum, that is, the rotation direction (the arrow a side) of the conveying belt 21, as a sub-scanning direction (first direction). A charging device (62*y*, 62*m*, 62*c*, 62*k*), developing roller (64*y*, 64*m*, 64*c*, 64*k*), transfer device (93*y*, 93*m*, 93*c*, 93*k*), spent toner recovery screw (66*k*, 66*m*, 66*c*, 66*k*), cleaning blade (65*y*, 65*m*, 65*c*, 65*k*) and discharging device (63*y*, 63*m*, 63*c*, 63*k*) extending in the main direction are arranged around, and along a rotation direction of, a corresponding photosensitive drum (61*y*, 61*m*, 61*c*, 61*k*) with a lower stirring roller (67*y*, 67*m*, 67*c*, 67*k*) and upper stirring roller (68*y*, 68*m*, 68*c*, 68*k*) arranged relative to the developing roller. The charging device, developing roller and transfer device serves as a charging means, developing means and transfer means, respectively.

It is to be noted that the respective transfer device is set relative to the photosensitive belt 21 in a sandwiching manner, that is, set on the inner side of the conveying belt 21 and that the light exposure spot by the later-described light exposure device is formed on the outer peripheral surface of the photosensitive drum at a place between the charging device and the developing roller.

Sheet cassettes 22*a*, 22*b* are disposed below the conveying mechanism 20 to hold a plurality of recording sheets P as a to-be-image-formed medium to which the image formed by a respective image forming section (10*y*, 10*m*, 10*c*, 10*k*) is transferred.

Pick-up rollers 23*a*, 23*b* are provided at one end portions of the sheet cassettes 22*a*, 22*b* and on the driven roller 92 side to allow respective sheets which are held in the sheet cassettes 22*a*, 22*b* to be picked up from the top sheets. Between the pick-up rollers 23*a*, 23*b* and the driven roller 92 a register roller 24 is arranged to allow the leading edge of the recording sheet P, which is picked up from the sheet cassette (22*a*, 22*b*), to be set in registry with the forwarding end of a y toner image formed on the photosensitive drum 61*y* in the image forming section 10*y*. In this connection it is to be noted that those toner images (m, c, k) formed on the other photosensitive drums 11*y*, 11*m* and 11*c* are supplied to the respective transfer positions in accordance with the conveying timing of the recording sheet P conveyed on the conveying belt 21. An attraction roller 26 is arranged, in the neighborhood of the driven roller 92, between the register roller 24 and the first image forming section 10*y*, that is, above the outer periphery of the driven roller 92 with the conveying belt 21 held relative thereto, to provide a predetermined electrostatic attraction force to the recording sheet P fed via the register roller 24 at a predetermined timing. In this connection it is to be noted that the axis of the attraction roller 26 and that of the driven roller 92 are arranged in a mutually parallel relation.

A positional displacement sensor 96 is arranged, in the neighborhood of the drive roller 91, at one end portion of the conveying belt 21, that is, above the outer periphery of the drive roller 91 substantially with the conveying belt 21 interposed. The sensor 96 is arranged in a spaced-apart relation to the drive roller 91 so as to detect the position of the image formed above the conveying belt 21. The sensor 96 is comprised of a transmitting- or reflecting-type optical sensor.

A conveying belt cleaning device 95 is arranged relative to the outer periphery of the drive roller 91 on a downstream side of the positional displacement sensor 96 to remove a deposited toner on the conveying roller 91 or sheet dust, and so on, originating from the recording sheet P.

On the side on which the recording paper P conveyed through the conveyor belt 21 is released from the drive roller 91, a fixing device 80 is arranged as a fixing means for melting a toner image transferred to the recording paper P, by heating the recording sheet P to a predetermined temperature, and fixing the toner image to the recording sheet P. The recording sheet P has its toner image fixed by the fixing device 80 to the recording sheet and is delivered by a pair of sheet delivery rollers 97.

A light exposure device 50 is adapted to form color-separated electrostatic latent images on the outer peripheral surfaces of the respective photosensitive drums and has a semiconductor laser 60 having its light emission controlled based on image data (y, m, c, k) of respective colors separated by a later-described image processing section. On the optical path of the semiconductor laser 60 a polygon mirror 51 and fθ lenses 52 and 53 are arranged in that order, the polygon mirror 51 being rotated by a polygon motor 54 for reflecting a laser beam and scanning it and the fθ lenses 52 and 53 being adapted to correct the focal point of the laser beam reflected through the polygon mirror 51 to allow the formation of an image.

Between the fθ lens 53 and the respective photosensitive drums 61*y*, 61*m*, 61*c*, 61*k*, first bend-back mirrors 55*y*, 55*m*, 55*c*, 55*k* are provided for allowing the laser beams of respective colors which are passed through the fθ lens 53 to be bent back toward the light exposure positions of the respective photosensitive drums and second and third bend-back mirrors (56*y*, 56*m*, 56*c*) and (57*y*, 57*m*, 57*c*) are provided for allowing the laser beams which are bent back by the first bend-back mirrors 55*y*, 55*m*, 55*c* to be further bent back, noting that the laser beam for black is bent back by the first bend-back mirror 55 and, thereafter, guided to the photosensitive drum 61*k* without passing through the other mirrors.

Figure 2:
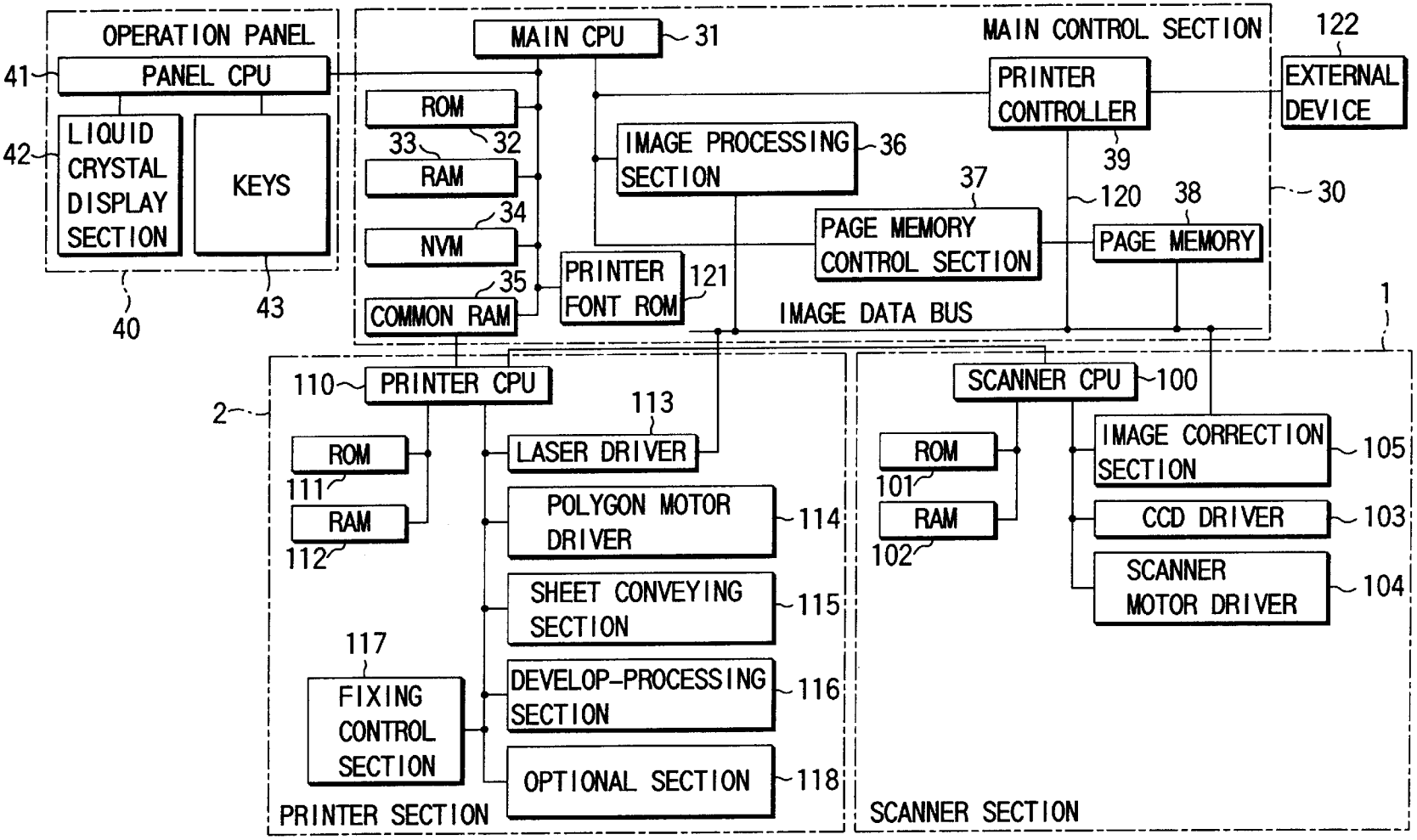
FIG. 2 is a block diagram showing an electrical connection of the full-color copying machine and a flow of control signals.

FIG. 2 is a block diagram diagrammatically showing an electrical connection of the full-color copying machine and a flow of signals under control. The full-color copying machine in FIG. 2 includes a main CPU 31 in its main control section 30, scanner CPU 100 in its scanner section 1 and printer CPU 110 in its printer section 2. The main CPU 31 makes a two-way communication to the printer CPU 110 via a common RAM 35 and issues an operation instruction to the printer CPU 110. The printer CPU 110 sends an involved status back to the printer CPU 110 and makes a serial communication to the scanner CPU 100. The printer CPU 110 issues an operation instruction to the scanner CPU 100 and the scanner CPU 100 sends an involved status back to the printer CPU 100.

An operation panel 40 is connected to the main CPU 31 and comprises a panel CPU 41 for controlling its whole, liquid crystal display unit 42 and keys 43.

The main control section 30 comprises the main CPU 31, ROM 32, RAM 33, NVM 34, common RAM 35, image processing section 36, page memory control section 37, page memory 38, printer controller 39 and printer font ROM 121.

The main CPU 31 controls a whole of the main control section 30 and the ROM 32 stores a control program therein. The RAM 33 temporarily stores data therein.

The NVM (a permanent random access memory: a non-volatile RAM) 34 is comprised of a nonvolatile memory backed up by a battery (not shown) and holds data therein when a power supply is cut off.

The common RAM 35 is used to make a two-way communication between the main CPU 31 and the printer CPU 110.

The page memory control section 37 stores image data in the page memory 38 and reads the data from the page memory 38. The page memory 38 has an area capable of storing image data corresponding to a plurality of pages and enables data, that is, data obtained by compressing the image data from the scanner section 1, to be stored in units of one page.

The printer font ROM 121 stores, therein, the font data corresponding to print data.

The printer controller 39 allows the print data from an external device 122, such as a personal computer, to be developed to image data with a given image resolution with the use of the font data stored in the printer font ROM 121, the image resolution corresponding to the data showing a resolution imparted to the print data.

The scanner section 1 comprises the scanner CPU 100 for controlling a whole of the scanner section 1, ROM 101 for storing control program, etc., RAM 102 for storing data, CCD driver 103 for driving a CCD image sensor 15, scan motor driver 104 for controlling the rotation of a motor for moving the light exposure lamp 5, mirrors 7, 11, 12, etc., and image correction section 105 comprising an A/D conversion circuit for converting an analog signal from the CCD image sensor 15 to a digital signal, shading correction circuit for correcting a variation in the CCD image sensor 15 or variation in a threshold level relative to an output signal from the CCD image sensor 15 which is caused due to an ambient temperature variation and line memory for temporarily storing the shading-corrected digital signal from the shading correction circuit.

The print section 2 comprises the print CPU 110 for controlling a whole of the printer section 2, ROM 111 for storing a control program, etc., RAM 112 for data storage, laser driver 113 for turning the light emission from the semiconductor laser 60 on and off, polygon motor driver 114 for controlling the rotation of the polygon motor 54 in the light exposure device 50, sheet conveying section 115 for controlling the conveyance of the sheet P by the conveying mechanism 20, develop-processing section 116 for charging, developing and transferring processes with the use of the charging devices 62*y*, 62*m*, 62*c*, 62*k*, developing rollers 64*y*, 64*m*, 64*c*, 64*k* and transfer devices 93*y*, 93*m*, 93*c*, 93*k*, fixing control section 117 for controlling the fixing device 80, and an optional section 118.

The image processing section 36, page memory 38, printer controller 39, image correcting section 105, laser driver 113 are connected together by means of an image data bus 120.

FIG. 3 diagrammatically shows the arrangement of the fixing device 80.

Figure 3A:
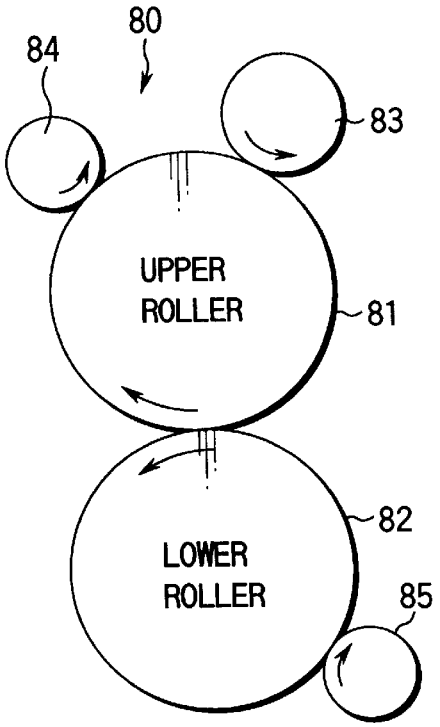
FIGS. 3A and 3B each are a view showing an outline of a fixing device.

In FIG. 3A, the fixing device 80 of a roller type comprises an upper roller 81, lower roller 82, oil roller 83 and felt cleaning rollers 84, 85.

The upper and lower rollers 81 and 82 are each comprised of a three-layer rubber roller formed by coating a silicon rubber, fluorine rubber and silicone rubber over a core metal in that order. In this case, the silicon rubber is comprised of a first layer 2 to 3 mm, fluorine rubber a second layer 10 to 100 $\mu$m and silicon rubber a third layer 50 to 200 $\mu$m in thickness. The three-layer rubber roller is better in thermal conductivity than the conventional rubber roller.

In the fixing device 80 of the present invention, the upper roller is of such a type that, instead of using a separation blade, it is rotated along with the oil roller under its oil viscosity of 300 CS in which case use is made of a spring load of 550 N.

Figure 3B:
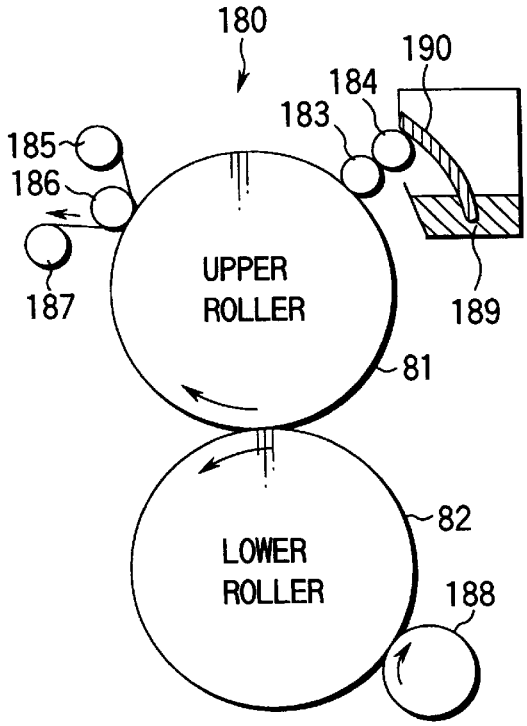

In the fixing device 180 as shown in FIG. 3B, a web cleaning is used for cleaning and oil tank is used for an oil supply member.

The fixing device 180 comprises an upper roller 81, lower roller 82, oil-coated rollers 183, 184, web roller 185, web pushing roller 186, web wind-up roller 187 and felt cleaning roller 188. It is to be noted that the oil in an oil tank 189 is coated by the oil-coated rollers 183, 184 onto the upper roller 81 through a felt 190.

Although the construction as shown in FIG. 3B can be used, the roller type fixing device 80 as shown in FIG. 3A will be explained below in connection with the present embodiment.

Figure 4:
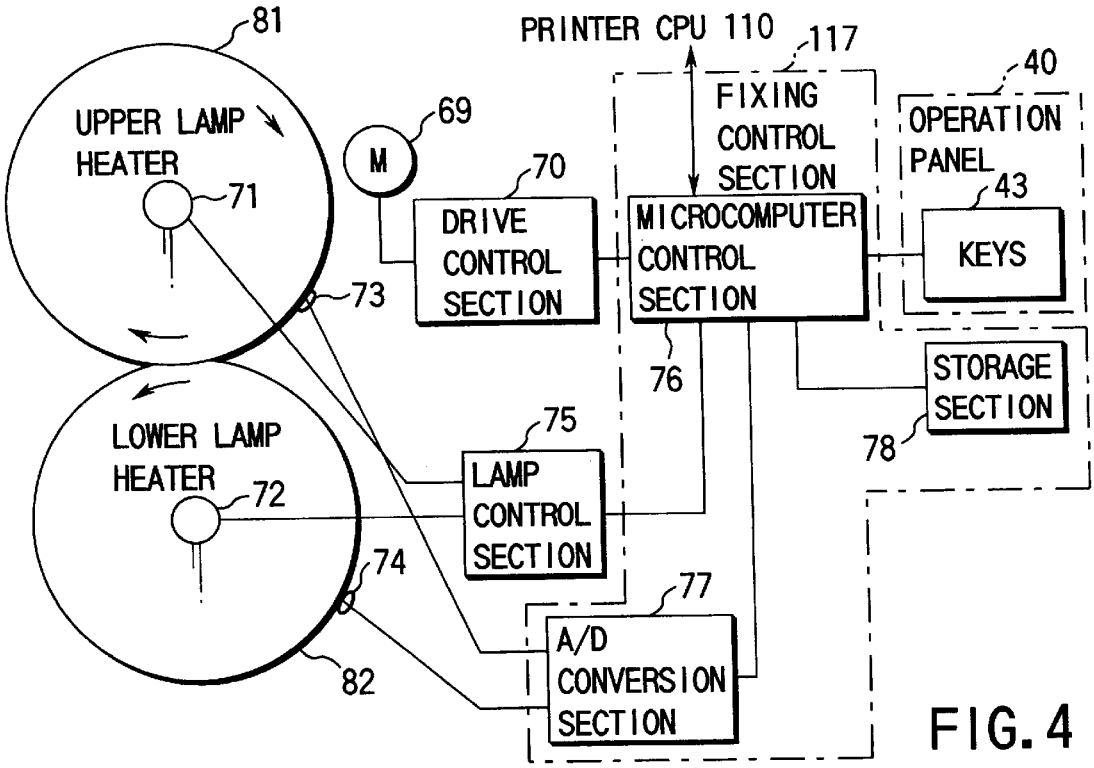
FIG. 4 is a view showing a control system of the fixing device.

FIG. 4 shows a control system for the fixing device. To the above-mentioned fixing control section 117 are connected a drive control section 70 for controlling a fixing device motor 69 for driving the fixing device 80, upper lamp heater 71 incorporated as a heating means in the upper heating means, lower lamp heater 72 incorporated as a heating means in the lower roller 82, sensing section (detecting means) 73, such as a thermistor, for detecting the surface temperature of the upper roller 81, sensing section (detecting means) 74, such as a thermistor, for detecting the surface temperature of the lower roller 82, lamp control section 75 for controlling the upper and lower lamp heaters 71 and 72 in an ON/OFF fashion, and keys 43 in the operation panel 40. It is possible to effect switching between a plain sheet mode and a sheetboard/OHP mode by the keys 43 serving as a setting means.

The upper lamp heater 71 is comprised of a 500 W lamp, such as a halogen lamp, while, on the other hand, the lower lamp heater 72 is comprised of a 400 W lamp, such as a halogen lamp.

The fixing control section 117 comprises a microcomputer control section 76, A/D conversion section 77 for converting analog signals from the sensing sections 73, 74 to digital signals, and storage section 78.

Figure 5:
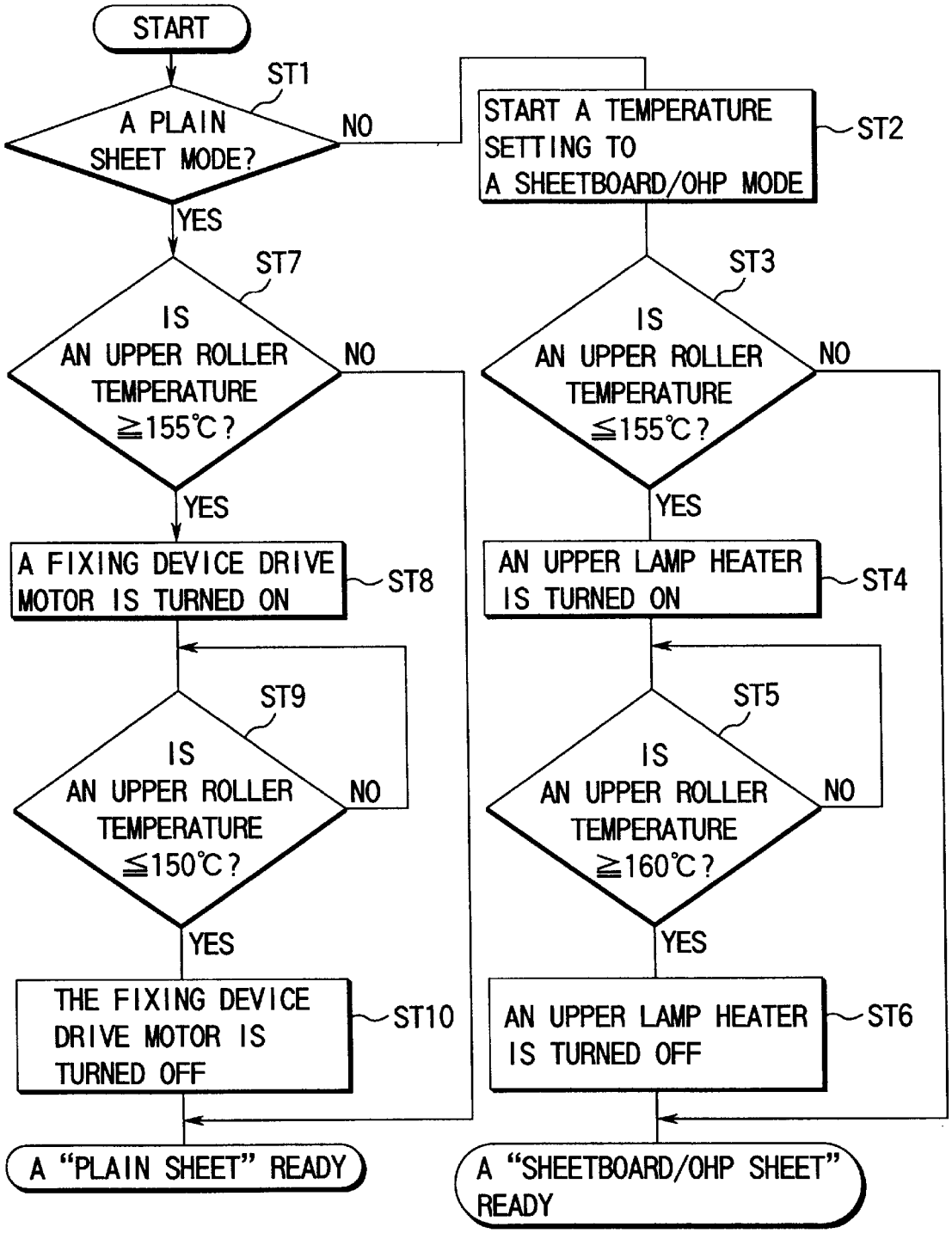
FIG. 5 is a flow chart for explaining a temperature control operation of the fixing device.

In this arrangement, the temperature control operation of the fixing device 80 will be explained below with reference to the flow chart of FIG. 5.

With the full-color copying machine ON, the microcomputer control section 76 turns the upper and lower lamp heaters 71 and 72 ON via the lamp control section 75 and detects the surface temperatures of the upper and lower rollers 81 and 82 by converting the detection signals of the sensing sections 73, 74 by the A/D conversion section 77 to digital signals.

When the surface temperatures of the upper and lower rollers 81 and 82 are detected as being 150° C., the microcomputer control section 76 turns the upper and lower lamp heaters 71 and 72 OFF through the lamp control section 75 and enables a ready (copyable) state to be displayed on the liquid crystal display section 42 in the operation panel 40. By doing so, the upper and lower lamp heaters 71 and 72 are ON/OFF controlled through the lamp control section 75 so as to maintain the surface temperatures of the upper and lower rollers 81 and 82 at 150° C.

Here, when the plain sheet mode is switched to the sheetboard/OHP mode by the inputting of the corresponding keys 43 (step ST1), the microcomputer control section 76 changes bit equivalents of the controlled temperature of the upper roller 81 so as to vary 150° to 160° C. By doing so, the temperature setting is started to the sheetboard/OHP mode (step ST2). The lower roller 82 is so controlled by the microcomputer control section 76 as to be maintained at a surface temperature of 150° C. at all times.

First, the microcomputer control section 76, confirming the surface temperature of the upper roller 81 from the detection signal of the sensing section 73 through the A/D conversion section 77, turns the upper lamp heater 71 ON (step ST4) if the surface temperature of the upper roller 81 is below 155° C. (step ST3).

And the microcomputer control section 76, effecting a continued confirmation of the surface temperature of the upper roller 81 from the detection signal of the sensing section 73 through the A/D conversion section 77, turns the upper lamp heater 71 OFF through the lamp control section 75 (step ST6) if the surface temperature a of the upper roller 81 is a ≧160° C. (step ST5). By doing so, the operation panel 40 displays a sheetboard/OHP ready (copyable) state on its liquid crystal display section 42. If the surface temperature of the upper roller 81 exceeds 155° C. at step ST3, the sheetboard/OHP ready (copyable) mode is displayed on the liquid crystal section 42 of the operation panel 40.

When, at the completion of copying in the sheetboard/OHP mode, the plain sheet mode is set (step ST1) by the inputting operation of the corresponding keys 43, that is, by being switched from the sheetboard/OHP mode, the microcomputer control section 76 changes the control temperature of the upper roller 81 to a bit equivalent so as to change that temperature from 160° to 150° C. In this connection it is to be noted that the lower roller 82 is so controlled by the microcomputer control section 76 as to be maintained at a surface temperature of 150° C. at all times.

The microcomputer control section 76, confirming the surface temperature of the upper roller 81 from the detection signal of the sensing section 73 via the A/D conversion section 76, turns the fixing device drive motor 69 ON through the drive control section 70 (step ST8) if the surface temperature a of the upper roller 81 is a ≧155° C. (step ST7). By doing so, the upper and lower rollers 81 and 82 in the fixing device 80 driven by the fixing device drive motor 69 starts to rotate (prerun). In order to lower the roller temperature to 10 deg., it takes 120 seconds to allow the roller to cool but, according to the present invention, it is possible to reduce that time down to 30 seconds. This means that the surface temperature of the upper roller 81 is made at the same temperature as that (150° C.) of the lower roller 82 so that it is possible to effect copying of the plain sheet.

The microcomputer control section 76, while effecting the continued confirmation of the upper roller's surface temperature from the detection signal of the sensing section 73 through the A/D conversion section 77, turns the fixing device drive motor 69 OFF through the drive control section 70 (step ST10) if it detects the surface temperature a of the upper roller 81 as being lowered to 150° C. (step ST10), so that a ready state (copyable state) of the plain sheet is displayed on the liquid crystal display section 42 in the operation panel 40.

Figure 6:
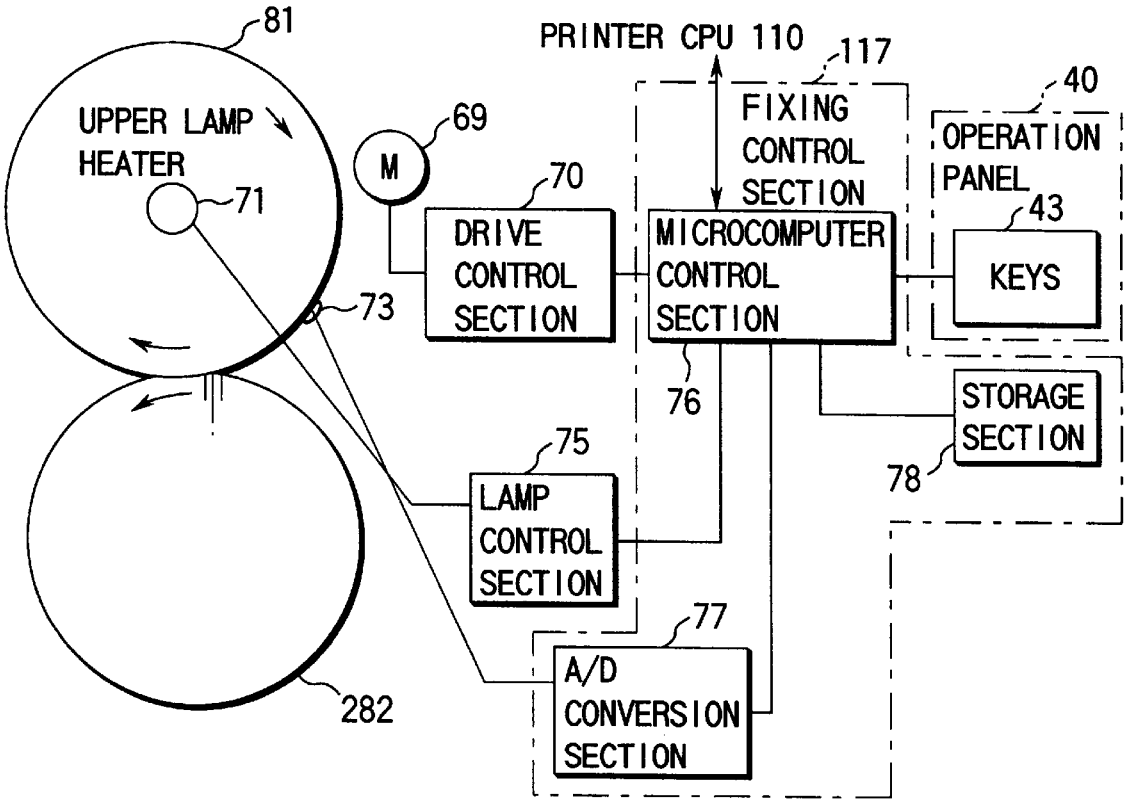
FIG. 6 is a view showing a control system in another form of the fixing device.

FIG. 6 shows a control system in another schematic form of the fixing device 80. That is, to a fixing control section 117 are connected a drive control section 70 for controlling a fixing device motor 69 for driving the fixing device 80, upper lamp heater 71 incorporated as a heating means in an upper roller 81 serving as a heating roller, lower roller 282 serving as a pressure-applying roller, a sensing section (detecting means) 73, such as a thermistor, for detecting the surface temperature of the heating roller 81, lamp control section 75 for controlling the upper lamp heater 71 in an ON/OFF fashion and keys 43 in an operation panel 40. It is possible to effect switching between the plain sheet mode and the sheetboard/OHP mode by the operation of corresponding keys serving as a setting means. The upper lamp heater 71 is comprised of a 500 W lamp such as a halogen lamp. It is to be noted that the fixing control section 117 comprises a microcomputer control section 76, A/D conversion section 77 for converting an analog signal from the sensing section 73 to a digital signal and storage section 78.

In the arrangement above, the lower roller 282 serving as a pressure-applying roller is simply of a pressure-applying type and not of a heating type, so that no particular temperature control is performed. If, however, the plain sheet mode is set by being switched from the sheetboard/OHP mode, it takes less time for the surface temperature of the upper roller 81 to be lowered than in the arrangement of FIG. 4. The temperature control operation of the fixing device 80 thus arranged is substantially the same as explained with reference to a flow chart shown in FIG. 5.

According to the above practical form of the present invention, by controlling the surface temperature of the upper roller to make it higher at a setting of the sheetboard/OHP mode than at the setting of the plain sheet, it is possible to, at the making of copying on the sheetboard and OHP sheet, obviate the need for making the copying speed at one half as low as otherwise and making the apparatus larger.

Further, by rotating the lower roller controlled at all times at a constant surface temperature and upper roller controllably settable to a higher surface temperature depending upon the kinds of mode, it is possible to shorten a time taken for the upper roller's surface temperature to be lowered.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

I claim:

1. A fixing device for fixing a toner image on a transfer material being fed thereto, while being held between rollers, at a predetermined fixing temperature, comprising:

a first roller;

heating means for heating the first roller;

a second roller set in contact with the first roller at a temperature lower than a temperature of the first roller;

switching means for effecting switching between a first mode for fixing the image to the transfer material at a first fixing temperature and a second mode for fixing the image to the transfer material at a second fixing temperature higher than the first fixing temperature;

first control means for heating the first roller at a higher temperature when the second mode is selected than when the first mode is selected; and second control means for controlling the second roller so that the second roller deprive heat of the first roller when switching is made by the switching means from the second mode to the first mode.

2. The fixing device according to claim 1, wherein the first and second rollers are each formed of a rubber roller.

3. The fixing device according to claim 2, wherein the first and second rollers are each comprised of a three-layer rubber roller provided by forming a silicon rubber, fluorine rubber and silicone rubber over a core metal in that order.

4. The fixing device according to claim 1, wherein the first and second rollers each have lamp heaters incorporated therein.

5. The fixing device according to claim 1, wherein the first mode is a mode for forming an image on a plain sheet and the second mode is a mode for forming an image on an OHP sheet and sheetboard.

6. The fixing device according to claim 1, wherein, when a surface temperature of the first roller is lowered, the second control means allows rotation control of the first and second rollers.

7. The fixing device according to claim 1, wherein, in the second mode, a surface temperature of the first roller is higher than in the first mode.

8. A method for controlling temperature of a fixing device for fixing a toner image on a medium being fed thereto while being held between first and second rollers, comprising the steps of:

(a) controlling a surface temperature of the first roller at a plurality of setting levels;

(b) controlling a surface temperature of the second roller to a level equal to the lowest setting level of the first roller; and (c) when the surface temperature of the first roller is to be lowered, controlling the two rollers in a way to set these rollers rotating in contact with each other.

* * * * *